US005647384A

United States Patent [19]

Haber et al.

[11] Patent Number: 5,647,384

[45] Date of Patent: *Jul. 15, 1997

[54] HAIR PIECES AND MOUNTING FOR HAIR PIECES

[76] Inventors: Judith A. Haber, 2942 W. 60th Dr., Merrillville, Ind. 46410; Sharon A. Haber, 610 Franciscan Dr.; Greta S. Lambert, 1031 E. Summit, both of Crown Point, Ind. 46307

[ * ] Notice: The term of this patent shall not extend beyond the expiration date of Pat. No. 5,337,763.

[21] Appl. No.: 290,208

[22] Filed: Aug. 15, 1994

Related U.S. Application Data

[63] Continuation-in-part of Ser. No. 827,160, Jan. 28, 1992, Pat. No. 5,337,763.

[51] Int. Cl.[6] ..... A41G 5/00

[52] U.S. Cl. ..... 132/105; 132/54; 132/275

[58] Field of Search ..... 132/53, 54, 56, 132/105, 275; 2/174, 207

[56] References Cited

U.S. PATENT DOCUMENTS

| | | | |
|---|---|---|---|
| D. 205,576 | 8/1966 | Day . | |
| 1,346,718 | 7/1920 | Muller . | |
| 1,367,172 | 2/1921 | Andresen . | |
| 1,519,107 | 12/1924 | Breslauer . | |
| 1,713,616 | 5/1929 | Oppenheim . | |
| 2,040,246 | 5/1936 | Donoher . | |
| 2,073,869 | 3/1937 | Jacoby | 132/53 |
| 2,352,529 | 6/1944 | Frankel . | |
| 2,567,119 | 9/1951 | Naidor . | |
| 2,574,558 | 11/1951 | Graber et al. . | |
| 2,651,310 | 9/1953 | Selson . | |
| 2,789,567 | 4/1957 | Jacoby . | |
| 2,795,232 | 6/1957 | Klein et al. . | |
| 2,889,557 | 9/1959 | Blair . | |
| 3,192,932 | 7/1965 | Hart . | |
| 3,433,234 | 3/1969 | Klugmann | 132/53 |
| 3,460,546 | 8/1969 | Abbott . | |
| 3,590,831 | 7/1971 | Buchheit | 132/53 |
| 3,694,819 | 10/1972 | Meyer . | |
| 3,817,260 | 6/1974 | Kleine . | |
| 3,881,501 | 5/1975 | Kleine . | |
| 4,016,889 | 4/1977 | Cowles | 132/56 |
| 4,492,242 | 1/1985 | Dalton . | |
| 4,576,189 | 3/1986 | Regina . | |
| 4,599,749 | 7/1986 | Childs et al. . | |
| 4,804,003 | 2/1989 | Moen . | |
| 4,825,886 | 5/1989 | Allen . | |
| 4,830,029 | 5/1989 | Bird . | |
| 4,966,173 | 10/1990 | Russell . | |
| 4,991,607 | 2/1991 | Chen . | |
| 5,137,037 | 8/1992 | Mochizuki . | |
| 5,154,196 | 10/1992 | Moffat . | |
| 5,303,724 | 4/1994 | Anzivino . | |

FOREIGN PATENT DOCUMENTS

| | | | |
|---|---|---|---|
| 70179 | 1/1983 | European Pat. Off. | 132/53 |
| 2117648 | 4/1971 | Germany . | |
| 2504129 | 1/1975 | Germany . | |
| 159420 | 3/1921 | United Kingdom . | |
| 234430 | 5/1925 | United Kingdom . | |
| 968071 | 8/1963 | United Kingdom . | |

*Primary Examiner*—Todd E. Manahan

*Attorney, Agent, or Firm*—Wood, Phillips, VanSanten, Clark & Mortimer

[57] ABSTRACT

Hair pieces and a mounting for a variety of hair pieces is disclosed. The hair piece includes a base with top and bottom sides. Hair strands extend from the top side of the base and an elongate piece of flexible material is attached to the bottom side of the base by parallel lines of stitching to define a conduit open at both ends. The conduit is dimensioned to receive devices such as headbands and other fasteners to secure the hair piece on the head of the wearer and to shape the hair piece. The conduit has a width of between about one-half inch and one-inch to accommodate the fasteners and headband. For a fuller, more natural look to the hair pieces, wefts of hair may also be provided on the bottom side of the base.

33 Claims, 5 Drawing Sheets

HAIR PIECES AND MOUNTING FOR HAIR PIECES

This is a continuation-in-part of U.S. patent application Ser. No. 827,160, filed on Jan. 28, 1992, now U.S. Pat. No. 5,337,763.

BACKGROUND OF THE INVENTION

1. Field of the Invention

The present invention relates to a hair piece to be used in supplementing the existing hair of the wearer, and more specifically, in one aspect, relates to a hair piece that can be used for both therapeutic and cosmetic enhancement of the hair of the wearer without requiring any hair pins for securing the hair piece on the head of the wearer. The hair piece of the first embodiment of the present invention may be used in combination with a variety of supports for securing the hair piece in place to give the wearer multiple options in appearance and use of the hair piece. In another aspect, the present invention relates to a unique mounting mechanism for a variety of hair pieces.

2. Description of the Prior Art

Wigs, wiglets and falls are well known. Such hair pieces have proven disadvantageous in some respects. For example, conventional wigs, wiglets and falls require pinning to the natural hair of the wearer to secure the hair piece in place. For wearers who have lost much of their natural hair, such as patients experiencing hair loss as a side effect of chemotherapy, conventional wigs, wiglets and falls may not be comfortably worn. Moreover, conventional hair pieces are not generally versatile, and more than one hair piece may be required to achieve different appearances.

SUMMARY OF THE INVENTION

It is an object of the present invention to provide a cranial prosthesis for the therapeutic enhancement of the hair of people who have experienced hair loss as a side effect of cancer therapy.

It is a further object of the present invention to provide a hair piece for the cosmetic enhancement of the natural hair of the wearer.

It is a further object of the present invention to provide a hair piece that can be securely placed on the head of the wearer without the use of hair pins, adhesives or weaving of the natural hair of the wearer into the hair piece.

It is a further object of the invention to provide such a hair piece that can be worn by a wearer having little or no natural hair in the vicinity of the hair piece.

It is a further object of the present invention to provide a hair piece that can be worn on a resilient plastic head band.

It is a further object of the present invention to provide such a hair piece that can be alternatively worn attached to a snood, turban or scarf.

It is a further object of the present invention to provide a hair piece that can be attached to a variety of support means for wearing on the wearer's head.

It is a further object of the present invention to provide such a hairpiece that conforms to the contour of the support means.

It is a further object of the present invention to provide a hair piece kit that includes a hair piece and a support means for the hair piece so that the hair piece can be removably attached to the support means for wearing.

It is a further object of the present invention to provide such a hair piece that can be readily transferred from one type of support means to another to provide the wearer with styling alternatives using a single hair piece.

It is a further object of the present invention to provide a mounting system that may be used for a variety of hair piece styles.

It is a further object of the present invention to provide a wig that covers a substantial part of the wearer's head and is mounted on a resilient headband for positioning on the wearer's head.

It is a further object of the present invention to provide a variety of hair piece styles providing a tunnel to receive mounting members for positioning and holding the hair pieces on the head of the wearer.

It is a further object of the present invention to provide a hair piece that may be worn as a pony tail to supplement the existing hair of the wearer.

It is a further object of the present invention to provide such a pony tail that includes a tunnel on its base for receiving a mounting member for holding and forming the pony tail around a portion of the wearer's existing hair.

In one aspect, the present invention provides a hair piece having a flexible base with top and bottom sides. Hair strands extend outwardly from the top side of the base and an elongate piece of material is attached to the base. The elongate piece of material has two open ends and is attached to the base to define an elongate conduit extending across a width of the base. The conduit provides an open path across a width of the base, the width of the path being between about one-half inch and one inch.

In another aspect, the present invention provides a hair piece having a flexible base with top and bottom sides. Hair strands extend outwardly from the top side of the base and an elongate piece of flexible material is attached to the bottom side of the base through two parallel lines of stitching. The two parallel lines of stitching are spaced apart between about one-half inch and one-inch and define a conduit open at both ends.

In another aspect, the hair piece of the present invention may include hair strands extending outwardly from the bottom side of the base beyond the edge of the base.

These aspects of the invention may be utilized with a variety of hair piece styles, from one designed to supplement the existing hair of the wearer on the top of the wearer's head to a fuller wig designed to cover a substantial part of the wearer's head, for the bald or nearly bald wearer, to a pony tail to be added to supplement the existing hair of the wearer and to cover the wearer's own pony tail.

DETAILED DESCRIPTION OF THE ILLUSTRATED EMBODIMENT

This is a continuation-in-part of U.S. patent application Ser. No. 07/827,160, filed Jan. 28, 1992, which application is completely and fully incorporated by reference herein.

The illustrated hair piece is adapted to be removably attached to a support means, which support means is then placed on the head or about the hair of the wearer. The hair piece is generally flexible along its longitudinal axis so that the hair piece conforms to the contour of the support means, which also generally conforms to the shape of the head of the wearer. In the first embodiment, the support means are interchangeable so that the hair piece may be worn on a resilient head band, on a hat, turban or scarf, for example.

Figure 1:
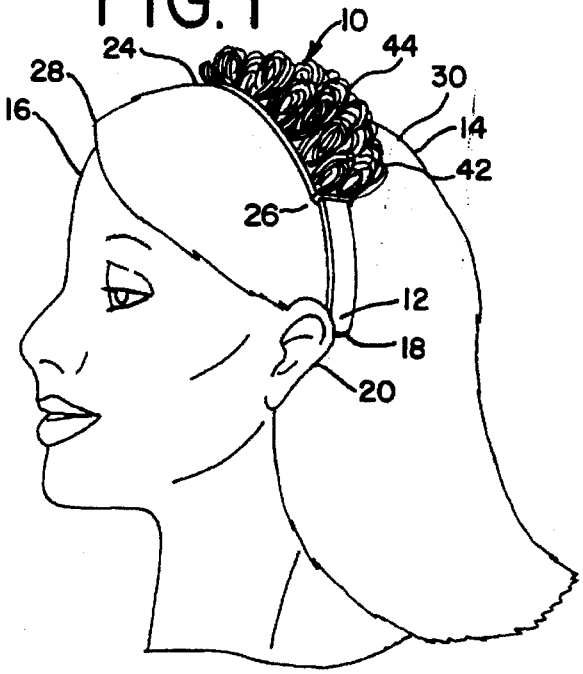
FIG. 1 is a schematic side view of the head and neck of a person wearing the hair piece of the present invention supported by a resilient head band, with portions of the wearer's natural hair removed for clarity of illustration.
Figure 3A:
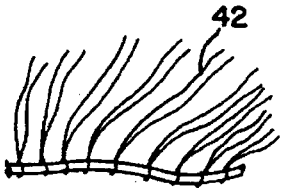
FIG. 3A is an enlarged view of a weft of hair.

Use of the hair piece of the first embodiment of the present invention on one alternative support means is illustrated in FIG. 1. As there illustrated, the hair piece 10 may be worn on a resilient head band 12 on the head 14 of a wearer 16. The head band 12 extends from one free end 18 positioned slightly behind one ear 20 of the wearer 16 to a second free end 22, shown in FIG. 2, positioned slightly behind the opposite ear of the wearer. The hair piece 10 is centered longitudinally on the head band, and is sized to extend across the top 24 of the wearer's head 14 and to extend slightly into the areas of the wearer's temples 26. Laterally, the hair piece is sized to fit between the wearer's natural hairline 28 at the wearer's forehead and the crown 30 of the wearer's head.

Figure 2:
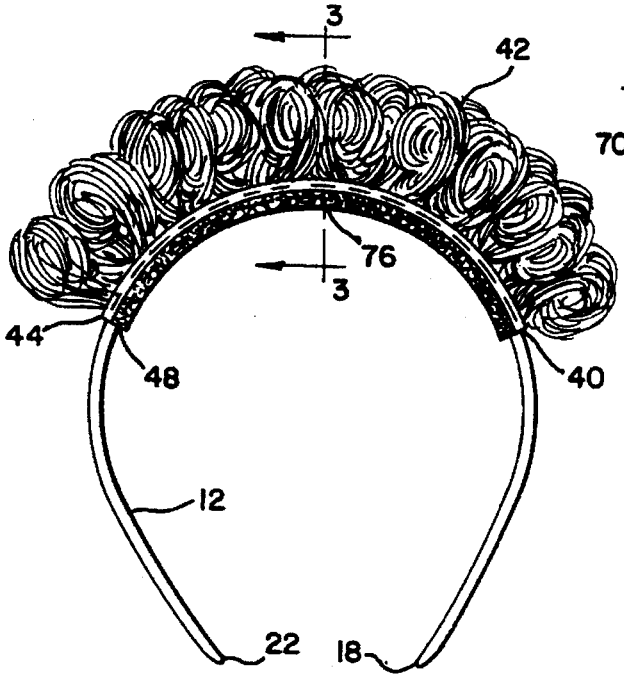
FIG. 2 is front view of the hair piece of the present invention in place on a resilient head band.
Figure 3:
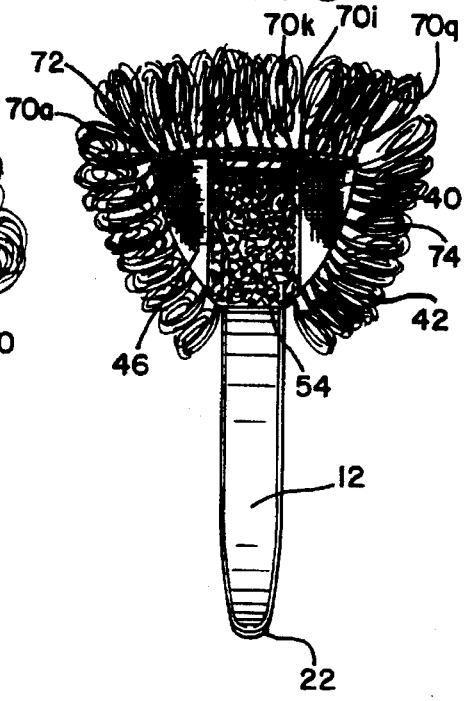
FIG. 3 is a cross sectional view of the hair piece of the present invention, taken along line 3—3 of FIG. 2.

As shown in FIG. 2, the head band 12 is a commercially available resilient band of plastic material having a general U-shape, or horse shoe shape. Preferably, the head band is made of a clear plastic material so that it is less visible when worn. Such head bands are generally flexible enough to allow them to be worn by a variety of people with varying head sizes. The bias of the head band tends to hold it in place on the wearer's head. In the illustrated embodiment, the head band is one-half inch wide and may have a plurality of teeth or grooves (not shown) to assist in holding the head band in place.

As shown in FIGS. 2–5, the hair piece 10 of the first embodiment of the present invention comprises a base 40 and hair strands 42 extending outwardly from the top side 44 of the base 40. The bottom side 46 of the base 40 is juxtaposed with the wearer's head, and has a longitudinal sleeve, tunnel or conduit 48 open at both ends 49, the sleeve being defined by an elongate strip of material attached to the bottom side of the base. The hair piece may be mounted on the head band 12 by sliding the head band through the sleeve on the base. The hair piece is readily removed from the head band by sliding the head band through the sleeve. When mounted on the head band, the contour of the hair piece generally conforms with the contour of the head band, as shown in FIGS. 1 and 2.

Figure 4:
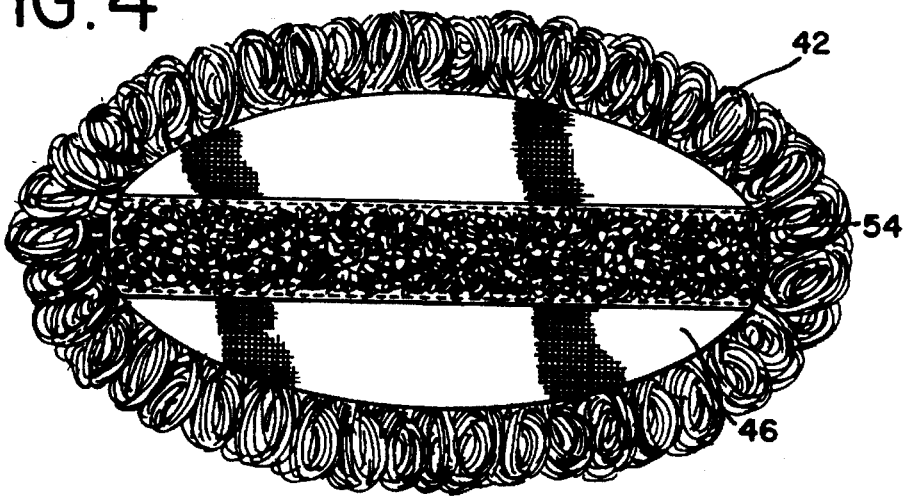
FIG. 4 is view of the bottom side of the hair piece of the present invention, with parts of the hair removed to illustrate the pattern of attachment of the underwefts of hair.
Figure 5:
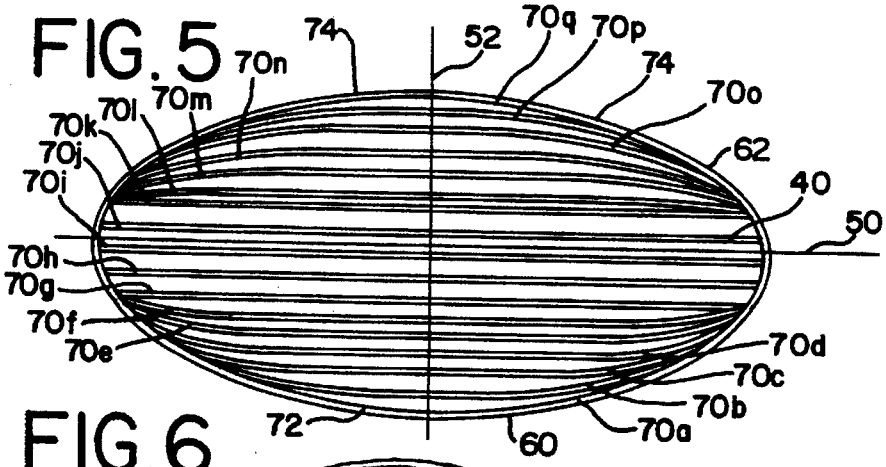
FIG. 5 is a top view of the hair piece of the present invention, with parts of the hair removed to illustrate one pattern of attachment for wefts of hair to the base of the hair piece.

As shown in FIGS. 4 and 5, the hair piece is generally flat when not in place on a support means. When flat, the hair piece base 40 of the first embodiment is generally oval shaped, with a major longitudinal axis 50 and a minor lateral axis 52. The base 40 is flexible along the longitudinal axis 50 so that the base and thereby the hair piece generally conforms to the contour of the support means when the hair piece is in place on the support means. Thus, as shown in FIG. 2, the hair piece is curved along the longitudinal axis, conforming to the curve of the head band, when in place on the head band.

In the first illustrated embodiment, the longitudinal sleeve or conduit 48 defines one possible means for removably attaching the hair piece to the support means, while allowing the hair piece to conform to the shape of the support means. The longitudinal sleeve 48 is formed by sewing an elongate strip of fastening material 54 onto the bottom side 46 of the base 40. Preferably, the fastening material 54 is the soft loop side of a hook and loop fastening material. A mating strip of the hook side of the fastening material may be secured to alternative support means. In the illustrated embodiment, the elongate strip of fastening material is of the type sold under the trade name "VELCRO". It is sewn to the base along two edges of the fastening material to define the sleeve 48 through which the head band may extend. The width between the stitch lines 55 and the width of the fastening material should be greater than the width of the head band to allow the hair piece to be easily slipped onto and off of the head band; the fit of the head band within the sleeve should be tight enough, however, so that the hair piece does not slide too easily on the head band, so that the hair piece is secure in place when worn on the head band.

The fastening material 54 is parallel to and extends over the longitudinal axis of the base 40. The illustrated base is symmetrical about its minor lateral axis 52, but is asymmetrical about its major longitudinal axis 50 so that the front 60 of the base 40 is wider than the rear 62 of the base. In the illustrated embodiment, the width of the front 60 part of the base from the longitudinal axis and along the minor lateral axis is about one and one-half inches, while the width of the rear 62 part of the base from the longitudinal axis along the minor lateral axis is about one and one-quarter inches. The additional width at the front of the base allows for more hair at the front of the hair piece, to provide added fullness from the head band toward the natural hair line 28 at the forehead when the hair piece is worn on the head band. The length of the illustrated hair piece, along the major longitudinal axis is about five and one-half inches.

With the hair piece so sized, the hair piece is generally long enough to extend across the top of the wearer's head and into the wearer's temples 26, with the more narrow part of the hair piece being at the wearer's temples, to make the hair more manageable when the piece is used on the head band support, to allow the wearer's natural hair at the temples to be intermingled with the hair of the hair piece for a more natural appearance. The base width is sufficient to provide a substantial amount of hair to be added to the wearer's natural hair, for added fullness, and for coverage of a portion of the scalp between the wearer's natural hair line 28 at the forehead and the crown 30 of the head.

Smaller oval shaped hair pieces may also be desirable in some applications.

The hair strands 42 extending from the top side 44 of the base may be of human hair or may comprise synthetic hair. It should be understood that as used in this patent specification and claims, the term "hair strands" is intended to mean both natural human hair and synthetic fibers. In the illustrated embodiment, the hair strands comprise modacrylic fibers. The hair strands may be hand tied to the base, or may be attached to the base in the form of wefts of hair, or a combination of the two may be used.

In the first illustrated embodiment, wefts of modacrylic fiber are used as the hair strands 42. As shown in FIG. 5, seventeen wefts 70*a*–70*q* of hair are sewn to the base. Each weft of hair comprises a flexible substantially linear base from which strands of hair extend in one direction. Each weft of hair 70*a*–70*q* is sewn to the hair piece base 40. The first weft 70*a* of hair is sewn along the front curved edge 72 of the hair piece base 40 with the weft forwardly directed. The seventeenth weft of hair 70*q* is sewn along the rear curved edge 74 of the hair piece base 40. The second through sixteenth wefts of hair 70*b*–70*p* are sewn to the hair piece base 40 in parallel lines substantially parallel to the major longitudinal axis 50 of the hair piece base 40. In the illustrated embodiment the first through the eleventh wefts of hair 70*a*–70*k* are sewn to the base with the wefts forwardly directed. Wefts twelve through seventeen 70*l*–70*q* are sewn to the base with the wefts rearwardly directed.

The majority of the parallel wefts 70*b*—70*b* are generally evenly spaced on the hair piece base 40. Thus, wefts two through eleven 70*b*–70*k* and wefts twelve through sixteen 70*l*–70*p* are spaced about three-sixteenths of an inch apart. However, wefts eleven 70*k* and twelve 70*l* are closely abutted to each other. Thus the wefts are closely abutted where the weft direction changes.

For added fullness and a still more natural appearance, underwefts 71 may be employed. These underwefts, illustrated in FIG. 4, are attached to the bottom side 46 of the base and are directed outwardly, with the hair strands extending beyond the edges 72, 74 of the base. The illustrated underwefts generally follow the shape of the edges 72, 74, and three such underwefts are sewn to the base and disposed within about one-half inch of the front and rear edges 72, 74. Other spacing and patterns of underwefts may also be employed. For example, underwefts could be attached in straight lines near the edges, and more or less than the three illustrated underwefts may be used.

As illustrated in FIG. 1, the front 72 and rear 74 curved edges of the base converge toward each other so that the base 40 is widest at its center, at the center 76 of the head band 12, on the top of the wearer's head, and most narrow at the wearer's temples 26.

The strip of fastening material 54 is about three-quarters to one inch wide in the illustrated embodiment, and is placed so that the front line of stitching attaching the strip to the hair piece base 40 is between the sixth 70*f* and seventh wefts 70*g* of hair and the rear line of stitching attaching the strip to the hair piece is at the abutment of the eleventh 70*k* and twelfth 70*l* wefts of hair. This configuration of the attachment of the wefts of hair alleviates the formation of a ridge at the change of weft direction and at the attachment of the strip of fastening material to the base. With a three-quarter inch strip of fastening material, a one-half inch wide head band should be easily slipped into and out of the sleeve 48 defined by the strip 54 and the hair piece base 40.

The hair pieces of the present invention may have a preset curl pattern. In the first illustrated embodiment, all seventeen wefts of hair have a rearward curl pattern formed by curling on one inch rods. Alternative curl patterns may be employed. For example, wefts fifteen 70*o* through seventeen 70*q* may not be curled, but left straight. Depending upon the range of styles to be used with the hair piece, all of the hair may be left straight. In addition, the hair may be preteased, or may be crimped near to the hair piece base 40 for added fullness.

In the first illustrated embodiment, the length of the hair of the hair piece is about five and one-half inches. However, the length of the hair may be varied, for example with position, on the hair piece. For example, the rear wefts of hair may be longer.

Figure 6:
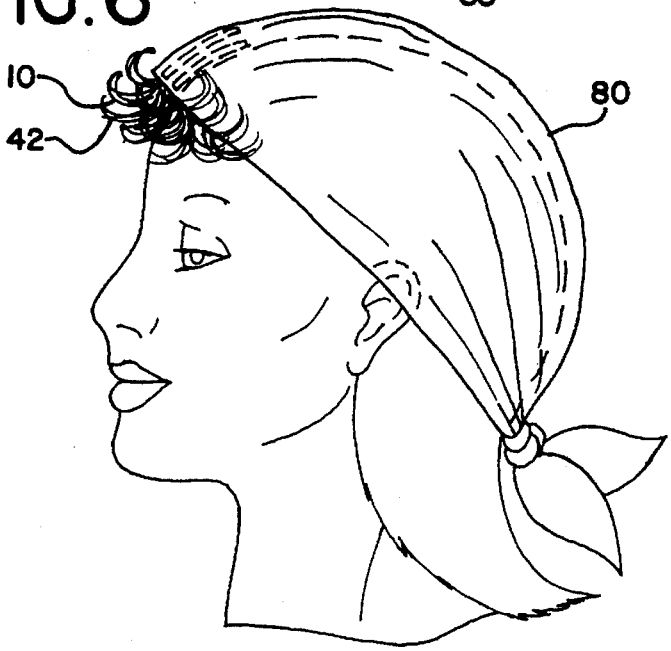
FIG. 6 is a schematic side view of the hair piece of the present invention removably attached to an alternate support means, that is, a snood worn around the head of the wearer.
Figure 7:
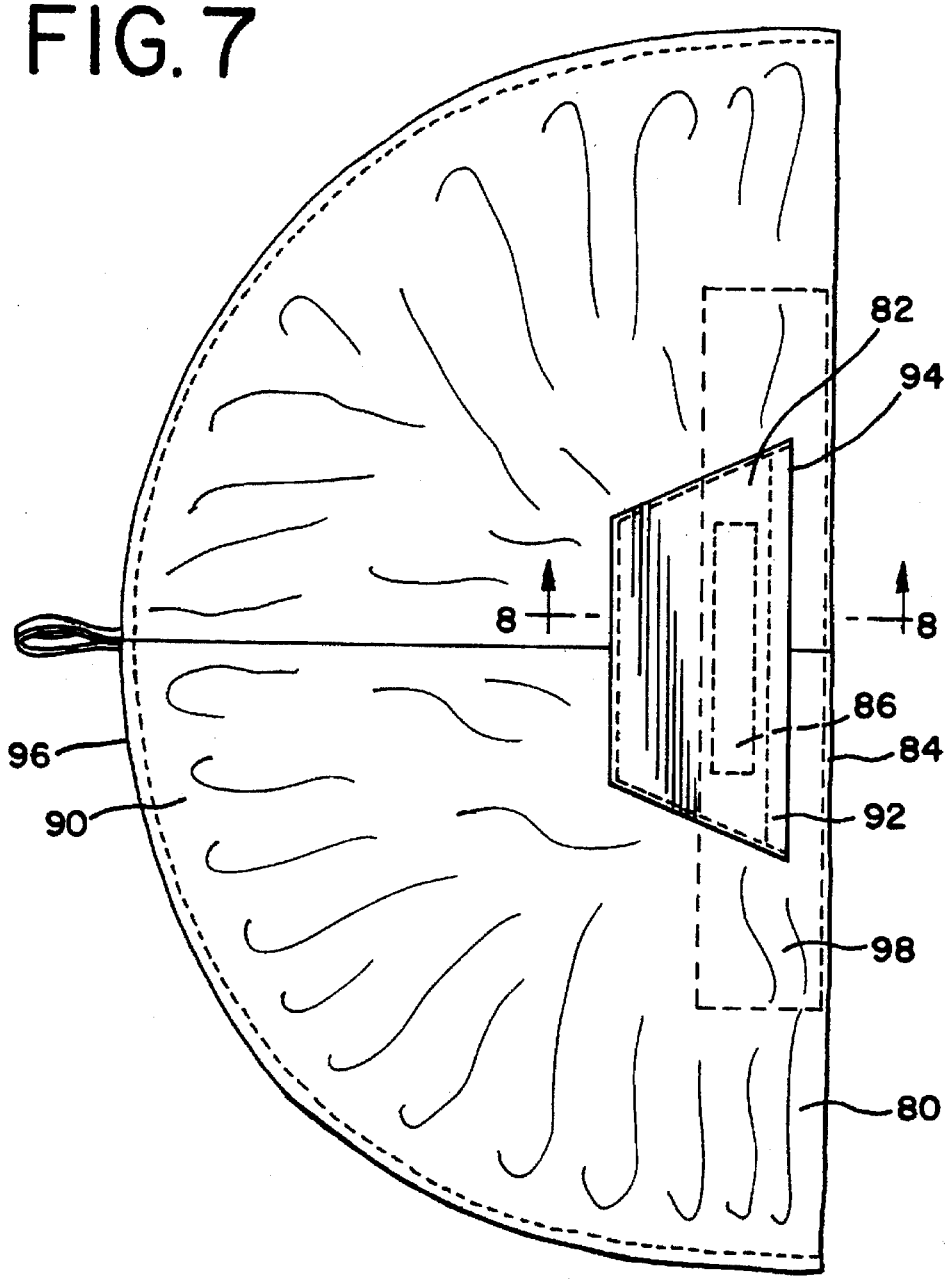
FIG. 7 is a bottom plan view of the snood of FIG. 6.
Figure 8:
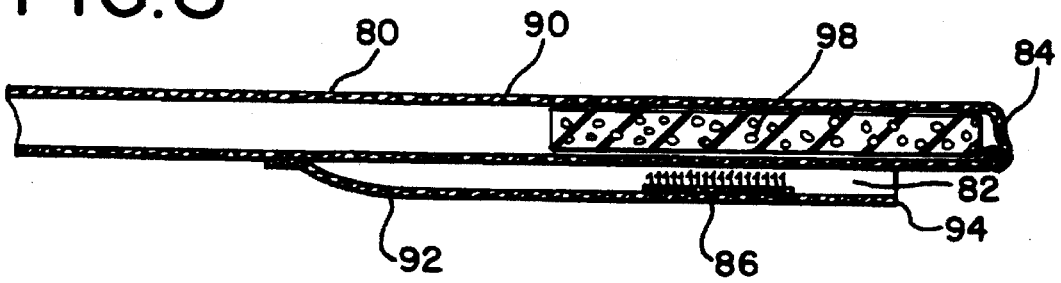
FIG. 8 is a cross sectional view of the snood of FIG. 7, taken along line 8—8 of FIG. 7.

As illustrated in FIGS. 6–8, the hair piece of the first embodiment of the present invention may be used interchangeably on a variety of support means. As there illustrated, the hair piece is shown in use with a snood 80 or scarf. The illustrated snood 80 defines a pocket 82 near the front edge 84. A mating strip of fastening material 86 is sewn into the pocket 82, and the fastening material 54 of the hair piece base 40 is thereby removably attached to the snood. The pocket 82 is large enough to hold the entire base flat.

As shown in FIG. 7, the snood 80 comprises two mating generally semi-circular pieces of material 90, or a circular piece of material folded along a diagonal defining the front edge 84, with a smaller trapezoidal piece of material 92 sewn along three of its edges to one side of the semi-circular piece of material 90 near and centered long the front edge 84. The front edge 94 of the trapezoidal material is not sewn to the semi-circular piece of material, but is left open to define the pocket 82 into which the hair piece may be inserted. The semi-circular edge 96 of the snood defines a sleeve through which a string is threaded for gathering the snood around the head of the wearer. An elongate strip of padding 98, which is a thin strip of a soft plastic foam material in the illustrated embodiment, is sewn within the semicircular pieces of material near to the front edge 84. The padding serves prevent any visible lumps where the hair piece fits within the pocket. When the snood is worn, the front edge 84 conforms to the shape of the wearer's head, thereby conforming the hair piece to the shape of the wearer's head.

The hair piece of the first embodiment of the present invention may also be worn with other support means. For example, a flexible turban or ring of stretchy fabric may have a mating strip of fastening material attached for attaching the hair piece to those support means when desired. It should also be understood that other means for removably attaching the hair piece to the support means may be used and are within the scope of the invention as claimed. For example, a plurality of snaps could be attached to one or both sides of the base 40 along the major longitudinal axis 50, with mating snaps attached to a head band and other support means. In addition, such snaps could be used in combination with the longitudinal sleeve of the illustrated embodiment, as for example, sewing snaps on the top side of the base along the major longitudinal axis, with a longitudinal sleeve sewn on the bottom side of the base, as illustrated. In such an embodiment, the hair piece could also be used with other support means, such as a decorative head band, with the head band being exposed above the hair piece.

The mounting system of the present invention, that is, the sleeve or tunnel on the base combined with a mounting member or means for removable securing the hair piece to the wearer, may be employed with a variety of hair piece styles. Other such styles and embodiments of the present invention are illustrated in FIGS. 9–12.

Figure 9:
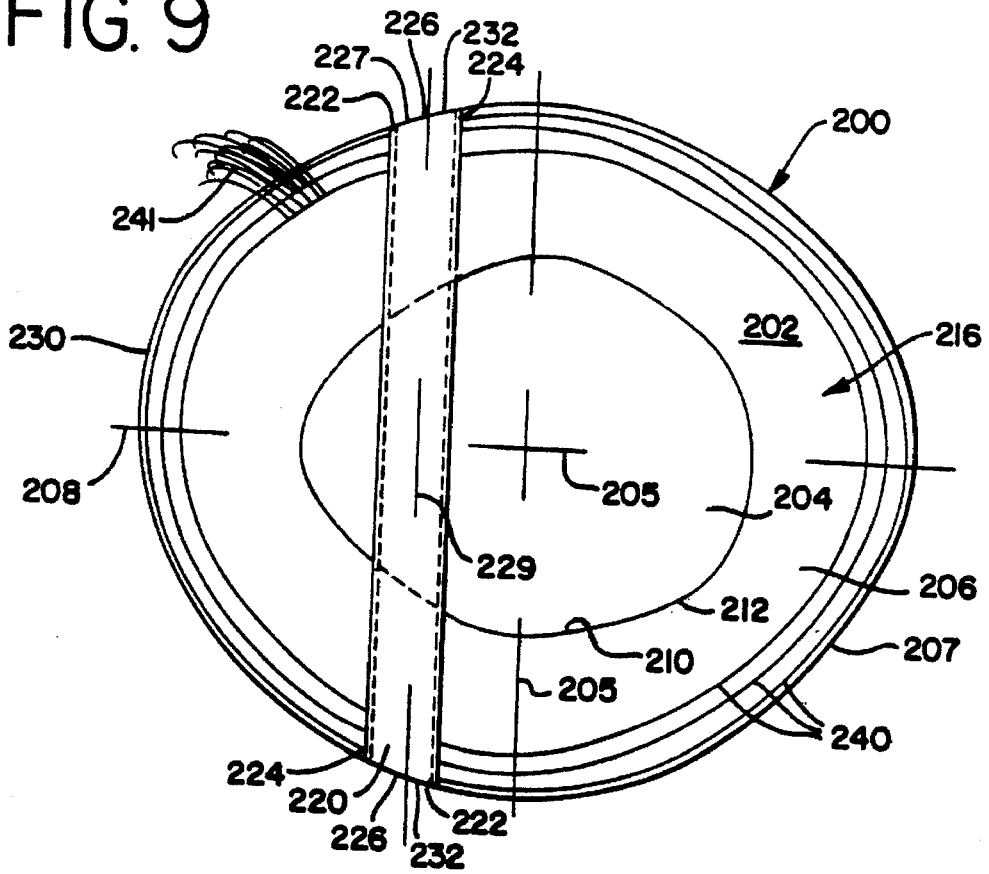
FIG. 9 is a bottom plan view of a second embodiment of the hair piece of the present invention, with parts of the hair removed for clarity of illustration of the hair weft pattern.
Figure 10:
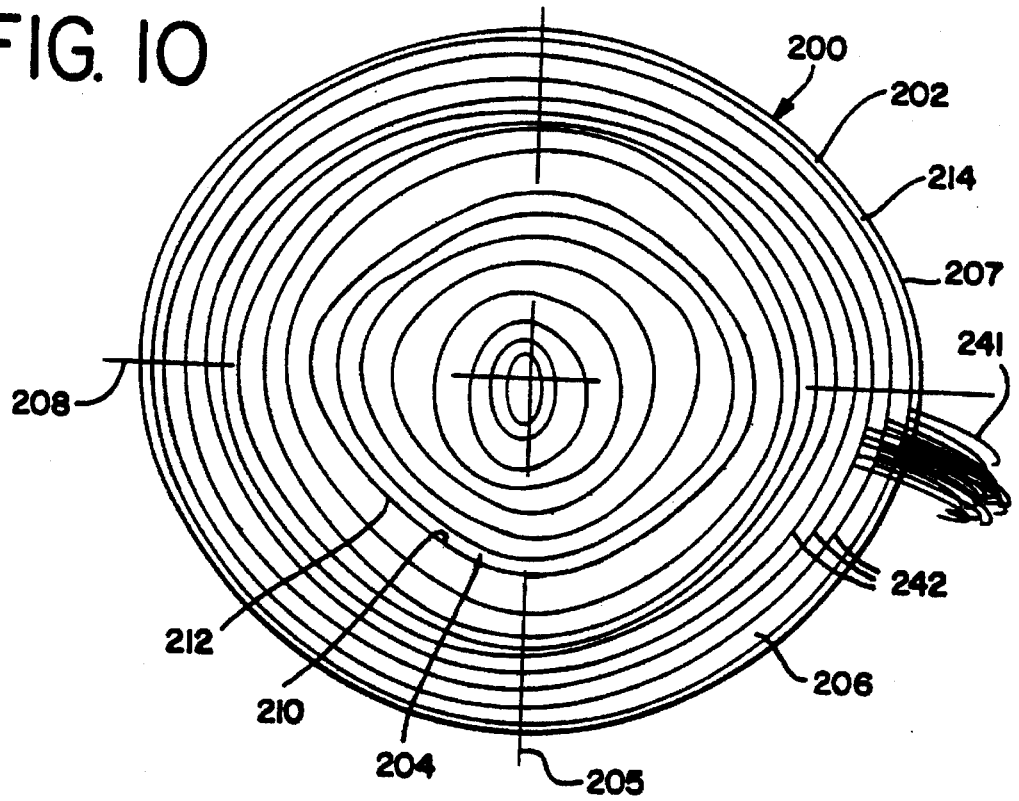
FIG. 10 is a top plan view of the embodiment of FIG. 9, with hair removed from the hair wefts for illustration.

In the second embodiment of the present invention, illustrated in FIGS. 9 and 10, the hair piece 200 is positioned on the head of the wearer by a resilient headband, as in the first embodiment, removably received in an open ended sleeve. As shown in FIGS. 9 and 10, the base 202 has an overall elliptical or oval shape. The base is comprised of an inner portion 204, which is oval or elliptical in the illustrated embodiment and has a major axis 205, surrounded by an outer portion 206, which has an outer edge 207 defining a larger oval or ellipse which also has a major axis 208. The two portions of the base are made of different material, the inner portion 204 being made of a stretchy mesh material, capable of being stretched about one-half inch in each direction, the outer portion 206 being made of a non-stretchy or less-stretchy mesh. The two fabrics are joined together by sewing along the outer edge 210 of the inner portion 204 and inner edge 212 of the outer portion 206. As shown in FIGS. 9 and 10, the major axis 205 of the inner portion 204 is parallel to and collinear with the major axis 208 of the overall base 202.

The base 202 of the second embodiment has a top side 214 and a bottom side 216. The bottom side is to be juxtaposed with the head of the wearer, and includes an elongate strip 220 of material three-quarters of an inch wide attached to the bottom side of the base by parallel lines of stitching 222 along the longitudinal edges 224 of the fabric. The material 220 extends across substantially the entire base, from edge to edge, and is open at both ends 226 to define a tunnel, conduit or sleeve 227 to receive a headband. It may be preferable for this type of hair piece to use a material such as velvet, to maximize comfort for the wearer, particularly if the wearer is substantially bald, rather than a fastening material such as VELCRO brand material, so that this hair piece could be worn comfortably by one who has lost substantial amounts of hair. As in the first embodiment, the hair piece conforms substantially to the shape of the resilient headband, and the resilience of the head band helps to hold the hair piece securely and in proper position on the wearer's head.

The strip of fabric in the second embodiment, like that in the first, is about three-quarters of an inch wide, and is sewn to define an open path between the lines of stitching 222 at least about one-half inch wide, that is, wide enough so that a head band of about one-half inch may be slid through from one of the open ends 226, through the tunnel or sleeve 227 between the lines of stitching and out the other end, with the hair piece then centered on the head band. The tunnel or path between the lines of stitching should be narrow enough to maintain the position of the hair piece on the headband, that is to prevent it from sliding transversely to the headband so that the position of the hair piece on the headband is maintained. In the illustrated embodiment, the tunnel 227 is greater than one-half inch in width and less than the width of the fabric, that is, less than about three-quarters of an inch. If a wider, one inch wide fabric is used, the tunnel would be less than one inch in width. The tunnel has a longitudinal axis 229 along which the headband may be slid laterally onto and off of the hair piece. The headband is large enough so that its free ends extend beyond the open ends of the tunnel.

The overall size of the hair piece of the second embodiment is larger than that of the first embodiment, to accommodate those wearers that are substantially bald. In the illustrated embodiment, the overall length of the base, along the major axis 208 of the overall base, is about eight and one-half (8½) inches, and the width at the widest point, its minor axis, is about seven and one-half (7½) inches. The inner portion 204 has a dimension along its major axis 205 of about five (5) inches and along its minor axis of about four (4) inches. It may be desirable in some applications to vary the shapes, and the inner and overall shapes may be circular or elliptical.

The strip 220 of fabric defining the sleeve or tunnel 227 for mounting the hair piece is located about one-third of the way back from the front 230 of the outer edge 207 of the base, and extends fully between the sides 232 of the outer edge 207. With the inner portion being made of a stretchy material, it may be desirable to form the conduit from a tube of material, and to use an elastic material for the conduit or portion of the conduit, and it may further be desirable to use an elastic stitching material to attach the tube to the base.

As in the first illustrated embodiment, a plurality of underwefts 240 of hair strands 241 are disposed around the outer edge 207 of the base in an elliptical array. Three underwefts are shown in the illustrated embodiment, disposed in the space about one-half inch from the outer edge 207 of the base, and are sewn to the base. The underwefts are directed outwardly so that the hair strands extend beyond the outer edge 207 of the base.

On the top side 214 of the base, a plurality of wefts 242 of hair strands 241 are sewn to the base. The hair wefts on the top side of the base may be sewn in a generally oval or elliptical array, with the wefts directed outwardly toward the outer edge 207 of the base. Other weft patterns may be employed, and different patterns may be employed on the different portions of the base, for example, using a random array of wefts on the inner portion 204 and an elliptical array on the outer portion 206. It may be desirable to more closely space the wefts near the seem joining the outer edge 210 of the inner portion and inner edge 212 of the outer portion of the base. It may also be desirable to use the linear pattern of wefts illustrated in the first embodiment of the invention.

With a hair piece sized as illustrated, the portion of the hair piece behind the elongate strip 220 may be stretched over the crown of the wearer's head for a snug fit conforming to the shape of the wearer's head. It may be desirable to employ additional securing means to ensure that the outer edge 207 of the hair piece remains snugly in position. For example, the outer edge 207 may be elasticized so that it conforms to the wearer's head. Alternatively, a pair of shaping wires may be employed, defining an "X" shape extending from the front 230 of the hair piece to the rear, the two wires crossing about three-quarters of the way back from the front 230 of the edge. Such a configuration of wires would help in assuring that the back portion of the hair piece is held down. As another alternative, fasteners may be employed at the front and rear of the hair piece.

Figure 11:
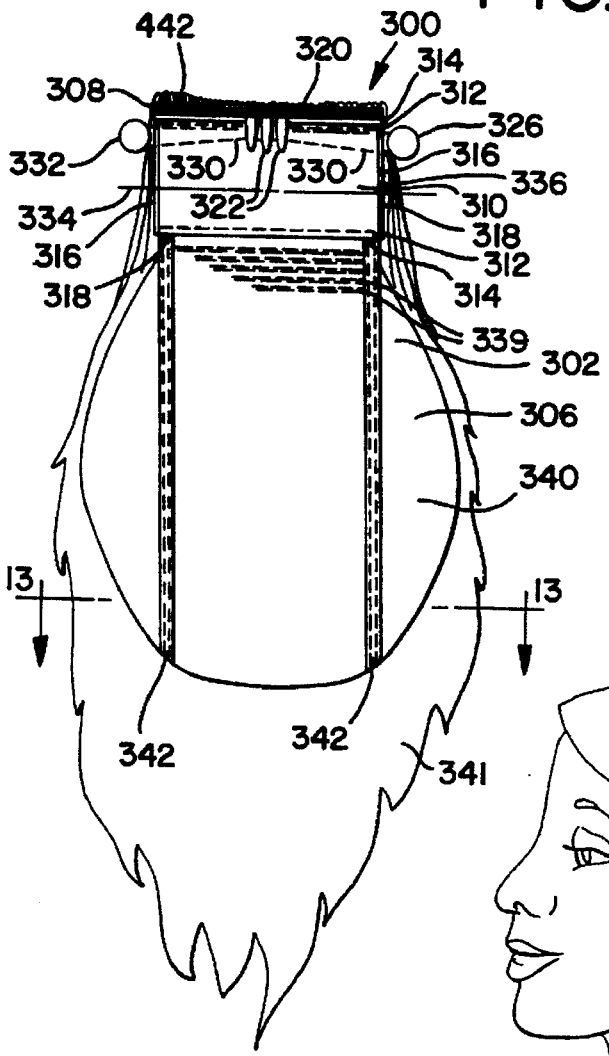
FIG. 11 is a bottom plan view of a third embodiment of the hair piece of the present invention.
Figure 12:
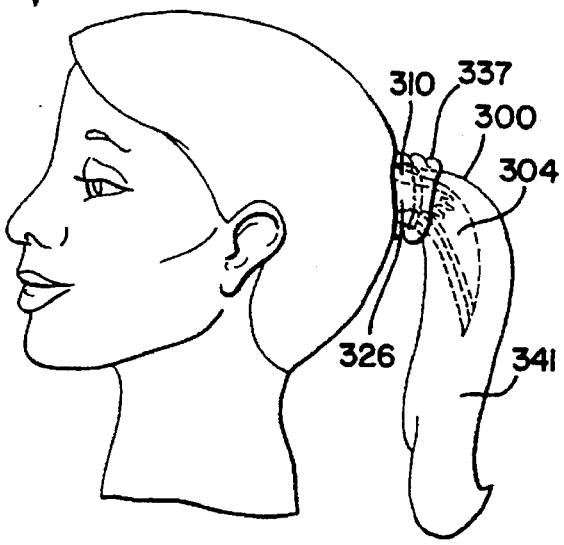
FIG. 12 is a side view of a wearer wearing the third embodiment of the present invention.
Figure 13:
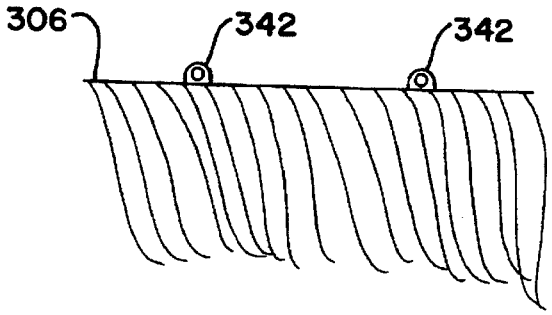
FIG. 13 is a cross-section taken along line 13—13 of FIG. 11.

A third alternative embodiment is illustrated in FIGS. 11–12. The third alterative hair piece 300 is adapted to be worn as a pony tail on the back of the head of the wearer. The pony tail hair piece 300 includes a base 302 having a top side 304 and a bottom side 306, and a straight upper edge 308. The length of the base, along the upper edge 308, may be around two to four inches. An elongate piece of material 310 is sewn to the base 302 along parallel lines of stitching 312, disposed along the two longitudinal edges 314 of the piece of material. The ends 316 of the strip are left open so that the attached strip defines a conduit, sleeve or tunnel 336. In this embodiment, a wider strip of material, about one inch wide, is used, defining an open conduit having a width greater than one-half inch and less than one inch. The elongate strip 310 is long enough to extend across the width of the base to near the parallel side edges 318, perpendicular to the upper edge of the base.

To assist in securing the pony tail to the head of the wearer, a wire comb 320 is attached sewn to the bottom side 306 of the base near the upper edge 308 of the base. The wire comb is positioned near the center of the upper edge, and extends for a portion of the length of the base. The wire teeth 322 of the comb overly the bottom side of the base, extending away from the upper edge 308 of the base at their free ends.

To further secure the pony tail on the head of the wearer, means for removably securing the hair piece to the wearer, comprising an elastic ball fastener 326 is employed in the illustrated embodiment. The elastic ball fastener 326 is of the type commonly available comprising a loop of elastic gathered at its center to form two loops 330, with a plastic ball mounted on each loop. In the illustrated embodiment, the elastic ball fastener is secured to the base at its center, as by sewing the center of the fastener to the base, with the center of the fastener being centered on the base near the upper edge 308 and below the attachment of the wire comb 322 to the base. The length of the elastic fastener is great enough that the balls at its ends 332 extend beyond the ends of the elongate material 310 and side edges 318 of the base. The elastic fastener is moveable along the longitudinal axis 334 of the conduit 336 by stretching the ends of the fastener.

In the illustrated embodiment, the elongate strip of material 314 is sewn over the elastic fastener so that the position of the loops of the elastic fastener are maintained by the elongate strip of fabric. It may be desirable to add a third line of stitching or other means to maintain the position of the ends of the elastic ball fastener outside of the conduit. The elongate strip of fabric is wide enough so that an elongate path free from obstruction is maintained through the tunnel formed by the elongate strip and the base.

To adorn and further secure the pony tail when worn, it may be desirable to use an additional securing device. One such device is a commercially available device comprising a flexible wire held loosely within an oversized decorative fabric sleeve that is closed at both ends. In such devices, the length of the encased wire 337 may be about eight to twelve inches. One end can be slid through the conduit 336 and the remainder of the encased wire wrapped around the hair piece as shown in FIG. 12.

As shown in FIG. 11, the base 302 has an oval extension 340 secured opposite the upper edge 308. The oval extension may be made of a stretchy mesh material, with the remainder of the base made with a different, non-stretchy or less stretchy mesh. The entire base includes hair strands, comprising linear wefts 339 of hair 341 attached to the top side 304 of the base, including the extension 340. The hair strands in this embodiment are substantially longer than those in the previous embodiments, to give the appearance of a long pony tail when worn. At least one underweft 442 is provided between the upper edge 308 of the base and the elongate piece of material 310, the underweft extending over the upper edge 308 of the base so that the upper edge is covered by hair strands.

To place the pony tail on the head of the wearer, the wearer's own hair is formed into a pony tail, secured by a rubber band or the like. The comb 320 is placed into the wearer's own hair above the rubber band and the elastic ball fastener 326 is pulled around the wearer's pony tail and the balls intertwined, securing the strip of fabric 310 around the wearer's pony tail. The decorative encased wire 337 may then be wrapped around the combined hair piece and wearer's pony tail as shown in FIG. 12.

To ensure that the wearer's natural pony tail is covered, the oval extension of the base may include a pair of linear encased flexible wires 342 extending generally perpendicularly to the upper edge 308 of the base, as shown in FIG. 11. These wires may alternatively be threaded through the mesh material of the base. The wearer may then squeeze the base around her natural pony tail and the encased flexible wires 342 will hold the base in position around the natural pony tail. Alternatively, it may be desirable to include an elastic pull around the edge of the base extension so that the elastic mesh extension may be gathered and secured around the wearer's natural pony tail, or formable wires extending parallel and near to the upper edge or on both sides of the conduit.

Thus, as these three embodiments illustrate, the present invention has provided a unique and useful new structure for securing a variety of hair piece types and styles to a wearer. In all of the embodiments, the hair piece has provided an elongate piece of material attached to the base to define a tunnel, conduit or sleeve 48, 227, 336 that extends the width of a portion of the base, the conduit being open at both ends and having a width of between about one-half inch and about one inch. So dimensioned, the hair piece can be used with a variety of means for removably securing the hair piece to the wearer, including resilient head bands, elastic ball fasteners, and the like. And when used with a support such as a headband, the dimensions of the conduit secure the position of the hair piece relative to the head band by limiting lateral movement of the hair piece on the headband while still allowing for longitudinal movement for removal of the headpiece from the headband. And if the elongate piece of material is a fastening material, such as VELCRO brand fastening material, some of the hair pieces may be combined with other decorative styling aids, such as decorative combs. Such a conduit can also be employed with appropriately sized barrettes.

We claim:

1. A hair piece comprising:

a flexible base having top and bottom sides, a width and an edge;

hair strands extending outwardly from the top side of the base;

an elongate piece of material having two ends, the elongate piece of material being attached to the base to define an elongate conduit providing an open path across a width of the base, the conduit having two open ends, the open path having a width between about one-half inch and about one-inch, the elongate piece of material having a length sufficient to extend substantially across a width of the base;

wherein the base is a two piece base comprising an inner portion of an elastic material and an outer portion of a different material, the two portions being connected.

2. A hair piece as claimed in claim 1 further comprising a pair of spaced parallel lines of stitching attaching the piece of material to the bottom side of the base, the two parallel lines of stitching being spaced apart a distance greater than about one-half inch and less than about one inch.

3. A hair piece as claimed in claim 2 wherein the piece of material comprises a strip of material having a width of between about three-quarters of an inch and one inch.

4. A hair piece as claimed in claim 1 wherein the two parallel lines of stitching extend along lines that divide the edge of the base into portions and the two parallel lines of stitching have parts that are spaced from the nearest portion of the edge of the base.

5. A hair piece as claimed in claim 1 wherein the conduit has a longitudinal axis, the hair piece further comprising means for removably securing the hair piece to a wearer, part of the securing means being disposed within the conduit and having two ends extending beyond the open ends of the conduit, the means for removably securing the hair piece being movable along the longitudinal axis of the conduit.

6. A hair piece as claimed in claim 5 wherein the means for removably securing the hair piece comprises an elastic fastener, the elastic fastener being stretchable within the conduit along the longitudinal axis of the conduit.

7. A hair piece as claimed in claim 6 further comprising a comb attached to the base.

8. A hair piece as claimed in claim 6 wherein the longitudinal axis of the conduit is a central axis lying along a line intersecting the base edge to define portions of the base edge.

9. A hair piece as claimed in claim 5 wherein the means for removably securing the hair piece comprises a resilient head band slidable through the longitudinal axis of the conduit.

10. A hair piece as claimed in claim 1 wherein the piece of material has a pair of longitudinal edges each lying along a line intersecting the edge of the base to define portions of the edge of the base, each longitudinal edge being nearer to one portion of the base edge than the other portion of the base edge and parts of the longitudinal edges being spaced from the nearer portion of the edge of the base.

11. A hair piece as claimed in claim 1 wherein the conduit has a central longitudinal axis and the base is elliptical with major and minor axes, the piece of material being attached to the base so that the central longitudinal axis of the conduit is parallel to one axis and perpendicular to the other axis of the base.

12. A hair piece as claimed in claim 11 wherein the piece of material comprises a strip of material having longitudinal edges attached to the base by stitching, the width of the strip of material being between about three-quarters of an inch and one inch.

13. A hair piece as claimed in claim 1 wherein the base has an overall elliptical shape with major and minor axes and the inner portion has an elliptical shape with a major axis parallel to the major axis of the base, the conduit being parallel to the minor axis of the base.

14. A hair piece as claimed in claim 1 further comprising a comb attached to the base.

15. A hair piece as claimed in claim 1 wherein the piece of material comprises an elongate strip of material having a width of between about three quarters of an inch and one inch and the base has a larger area than the elongate strip of material.

16. A hair piece comprising:

a flexible base having top and bottom sides, a width and an edge;

hair strands extending outwardly from the top side of the base;

two parallel lines of stitching;

an elongate piece of flexible material attached to the bottom side of the base by the two parallel lines of stitching, the two parallel lines of stitching being spaced apart a distance between about one-half inch and about one inch, the elongate piece of flexible material and two parallel lines of stitching having lengths and being positioned to extend across a width of the base, the elongate piece of flexible material and two parallel lines of stitching defining a conduit open at both ends and extending across a width of the base;

wherein the conduit has a longitudinal axis and the base is elliptical with major and minor axes, the elongate material being attached to the base so that the longitudinal axis of the conduit is spaced from one axis and perpendicular to another axis of the base; and wherein the base is a two piece base comprising an inner portion of an elastic material and an outer portion attached to the inner portion, the outer portion being made of a different material.

17. A hair piece as claimed in claim 16 wherein the inner portion of the base has an elliptical shape with major and minor axes and the major axis of the inner portion of the base is parallel to the major axis of the base.

18. A hair piece as claimed in claim 16 further comprising an elastic fastener attached to the bottom side of the base within the conduit, the elastic fastener having two ends extending past the open ends of the conduit.

19. A hair piece as claimed in claim 16 wherein the conduit has a central longitudinal axis lying along a line intersecting the base edge to define portions of the base edge.

20. A hair piece comprising:

a flexible base having top and bottom sides, a width and an edge;

hair strands extending outwardly from the top side of the base;

two parallel lines of stitching;

an elongate piece of flexible material attached to the bottom side of the base by the two parallel lines of stitching, the two parallel lines of stitching being spaced apart a distance between about one-half inch and about one inch, the elongate piece of flexible material and two parallel lines of stitching having lengths and being positioned to extend across a width of the base, the elongate piece of flexible material and two parallel lines of stitching defining a conduit open at both ends and extending across a width of the base, wherein the base has a straight upper edge and the parallel lines of stitching are parallel to and spaced from the straight upper edge of the hair piece; and further comprising a pair of wires secured to the base along a substantial part of the lengths of the wires in a direction perpendicular to the upper edge of the base.

21. A multi-use hair piece kit for use on the head of a person, the kit comprising:

a support means to be worn across the head of a wearer from near one ear to near the other ear;

a hair piece for covering a portion of the head of the wearer, the hair piece including, a flexible base;

hair strands attached to and extending outwardly from one side of the base; and means for removably attaching the hair piece to the support means, said means for removably attaching the hair piece to the support means permitting the flexible base of the hair piece to conform to the shape of the support means;

wherein the flexible base of the hair piece has an elongated substantially oval shape with a major axis and a minor axis and wherein the means for removably attaching the hair piece to the support means comprises an elongate strip of fastening material attached to the hair piece base to define a sleeve along the major longitudinal axis of the base, and wherein the fastening material comprises one side of a hook and loop fastening material.

22. A multi-use hair piece kit as claimed in claim 21 wherein the major axis divides the hair piece into front and back portions, the base being symmetrical about the minor axis and asymmetrical about the major axis so that the front portion of the base is wider than the back portion of the base, the elongate strip being substantially centered on the major axis of the base.

23. A multi-use hair piece as claimed in claim 22 wherein the hair strands comprise a plurality of wefts of hair attached to the base in substantially parallel lines substantially parallel to the major axis of the base.

24. A hair piece comprising:

a flexible base having top and bottom sides and an edge, the base including an inner portion having an outer edge and an outer portion, the inner portion being made of an elastic material and the outer portion being made of a different material and having an inner edge attached to the outer edge of the inner elastic portion and an outer edge spaced from the inner elastic portion;

hair strands extending outwardly from the top side inner elastic portion and outer portion of the base;

material attached to the base to define a conduit providing an open path across a dimension of the base, the conduit having two open ends, the open path having a width between about one-half inch and about one-inch, the material having a length sufficient to extend substantially across a dimension of the base.

25. A hair piece comprising:

a flexible base having top and bottom sides, an edge and a flexible elongate conduit providing an open path across a dimension of the bottom side of the base, the conduit having open ends;

hair strands extending outwardly from the top side of the base; and a flexible elastic member disposed in the conduit and having free ends outside of the conduit, the flexible member lying across the base;

wherein the base, conduit and flexible member are capable of being reversibly shaped to encircle a round object and to lie flat; and further comprising a deformable wire secured to the base along a substantial part of the length of the deformable wire.

26. A hair piece as claimed in claim 25 wherein the flexible member comprises an elastic ball fastener.

27. A hair piece as claimed in claim 25 further comprising a flexible comb attached to the base.

28. A hair piece as claimed in claim 25 further comprising a flexible comb attached to the base.

29. A hair piece comprising:

a flexible base having top and bottom sides, an edge and an elongate conduit providing an open path across a dimension of the bottom side of the base, the conduit having open ends;

hair strands extending outwardly from the top side of the base;

a comb attached to the base adjacent to the elongate conduit; and a deformable wire secured to the base along a substantial part of the length of the deformable wire for reversibly shaping the base.

30. A hair piece comprising:

a flexible base having top and bottom sides, an edge and a flexible elongate conduit providing an open path across a dimension of the bottom side of the base, the conduit having open ends and a width between about one-half inch and about one inch;

hair strands extending outwardly from the top side of the base; and a flexible mounting member disposed in the conduit and having free ends outside of the conduit;

a deformable wire secured to the base outside of the conduit along a substantial part of the length of the deformable wire for reversibly shaping the base.

31. A hair piece as claimed in claim 30 wherein the flexible mounting member lies across the base.

32. A hair piece as claimed in claim 30 further comprising an additional deformable wire secured to the base outside of the conduit along a substantial part of the length of the deformable wire for reversibly shaping the base.

33. A hair piece for use as an add-on pony tail capable of being removably attached to the hair on the head of a wearer to substantially surround the wearer's natural pony tail, the hair piece comprising:

a flexible base having top and bottom sides, an edge and a flexible elongate conduit providing an open path across a dimension of the bottom side of the base, the conduit having open ends and longitudinal confines lying across the bottom side of the base, the longitudinal confines being substantially parallel to an edge of the base;

hair strands extending outwardly from the top side of the base;

an elastic flexible fastener disposed in the conduit and having free ends outside of the conduit, the fastener lying across the base;

a flexible comb attached to the bottom side of the base for securing the hair piece to the hair of the wearer; and a deformable wire secured to the base along a substantial part of the length of the deformable wire for reversibly shaping the base;

wherein the base, conduit, comb and fastener are capable of being reversibly shaped to substantially surround the wearer's natural pony tail and to lie flat.

* * * * *